US007770946B2

(12) United States Patent
Kouzuma

(10) Patent No.: US 7,770,946 B2
(45) Date of Patent: Aug. 10, 2010

(54) DOOR LOCK DEVICE FOR VEHICLE

(75) Inventor: Hiroyuki Kouzuma, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 4 days.

(21) Appl. No.: 11/822,425

(22) Filed: Jul. 5, 2007

(65) Prior Publication Data

US 2008/0022736 A1 Jan. 31, 2008

(30) Foreign Application Priority Data

Jul. 11, 2006 (JP) ..... 2006-190294
Jul. 11, 2006 (JP) ..... 2006-190295

(51) Int. Cl.
*E05C 3/06* (2006.01)

(52) U.S. Cl. ..... 292/201; 292/216; 292/DIG. 23

(58) Field of Classification Search ..... 292/216, 292/201, DIG. 23
See application file for complete search history.

(56) References Cited

U.S. PATENT DOCUMENTS 6,062,615 A * 5/2000 Hunt et al. ..... 292/336.3
7,111,878 B2 * 9/2006 Kachouh ..... 292/216
2006/0202485 A1 * 9/2006 Yamamoto et al. ..... 292/201

FOREIGN PATENT DOCUMENTS

JP 3180039 B2 4/2001
JP 2003-106023 A 4/2003

* cited by examiner

*Primary Examiner*—Carlos Lugo
*Assistant Examiner*—Mark Williams
(74) *Attorney, Agent, or Firm*—Arent Fox LLP

(57) ABSTRACT

A door lock device for a vehicle includes a latch mechanism having a latch rotatable to pass a half-latch state to a full-latch state, a closer mechanism capable of forcedly turning the latch from the half-latch state to the full-latch state, and an actuator for driving the closer mechanism. A casing forming a part of the latch mechanism is secured to the door so as to turnably support the latch. An extending support part extending in a direction orthogonal to a turning axis of the latch is connectedly provided in the casing. The closer mechanism is adapted to be operated on a plane orthogonal to the turning axis of the latch, and is disposed between the actuator and the extending support part so as to be aligned with the latch mechanism. Thus, it is possible to construct the door lock device to be thin so as to be easily disposed in a door.

1 Claim, 9 Drawing Sheets

DOOR LOCK DEVICE FOR VEHICLE

BACKGROUND OF THE INVENTION

1. Field of the Invention

The present invention relates to a door lock device for a vehicle, comprising: a latch mechanism having a latch which can be rotated to pass a half-latch state where the door is half closed and reach a full-latch state where the door is fully closed while the door is operated from an opened state to a closed state; a closer mechanism capable of forcedly turning the latch from the half-latch state to the full-latch state; and an actuator having an electric motor and driving the closer mechanism with power generated by the electric motor.

2. Description of the Related Art

Such a door lock device for a vehicle has already been disclosed in Japanese Patent No. 3180039 and Japanese Patent Application Laid-open No. 2003-106023. In the door lock device disclosed in Japanese Patent No. 3180039, a closer mechanism and an actuator are disposed in an extending support part connected substantially at right angles to the casing of a latch mechanism. Also, in the door lock device disclosed in Japanese Patent Application Laid-open No. 2003-106023, a closer mechanism and an actuator are disposed so as to be superposed on a latch mechanism.

Both the door lock devices disclosed in Japanese Patent No. 3180039 and Japanese Patent Application Laid-open No. 2003-106023 have a disadvantage when being disposed in a limited space in a door because the entire door lock device is liable to be large.

In addition, the door lock device disclosed in Japanese Patent No. 3180039 has a disadvantage when being disposed in a limited space in the door because the closer mechanism is large and complicated.

SUMMARY OF THE INVENTION

The present invention has been achieved in view of the above circumstances. The present invention has a first object to provide a door lock device for a vehicle, which is constructed to be thin so as to be easily disposed in a door, and a second object to provide a door lock device for a vehicle, in which a closer mechanism can be simply constructed with a small number of parts thereby easily disposing the door lock device in a door.

In order to achieve the first object, according to a first feature of the present invention, there is provided a door lock device for a vehicle, comprising: a latch mechanism having a latch which can be rotated to pass a half-latch state where the door is half closed and reach a full-latch state where the door is fully closed while the door is operated from an opened state to a closed state; a closer mechanism capable of forcedly turning the latch from the half-latch state to the full-latch state; and an actuator having an electric motor and driving the closer mechanism with power generated by the electric motor, wherein the door lock device further comprises a casing forming a part of the latch mechanism, secured to the door so as to turnably support the latch, and having an extending support part which extends in a direction orthogonal to a turning axis of the latch; wherein the actuator is mounted in the casing including the extending support part so as to cover the extending support part; and wherein the closer mechanism is adapted to be operated on a plane orthogonal to the turning axis of the latch, and is disposed between the actuator and the extending support part so as to be aligned with the latch mechanism.

Also, according to a second feature of the present invention, in addition to the first feature, the closer mechanism is disposed above the latch mechanism.

With the first and second features, the actuator and the closer mechanism are aligned with the latch mechanism, thereby constructing the entire door lock device to be thin. Therefore, the present invention has an advantage in disposing the door lock device in a limited space in the door.

According to a third feature of the present invention, in addition to the first and second features, the door lock device further comprises a mechanical cancel mechanism which shuts off the closer mechanism from the latch corresponding to an operation of a door opening operation handle during an operation of the closer mechanism. With the third feature, it is possible to stop the forced rotation of the latch form the half-latch state to the full-latch state by operating the door opening operation handle during the operation of the closer mechanism, thereby securing safety in emergency.

According to a fourth feature of the present invention, in addition to the third feature, at least a part of the mechanical cancel mechanism is arranged between the actuator and the extending support part. With the fourth feature, it is possible to further compactly construct the entire door lock device including the mechanical cancel mechanism.

In order to achieve the second object, according to a fifth feature of the present invention, there is provided a door lock device for a vehicle, comprising: a latch mechanism having a latch which can be rotated to pass a half-latch state where the door is half closed and reach a full-latch state where the door is fully closed while the door is operated from an opened state to a closed state; a closer mechanism capable of forcedly turning the latch from the half-latch state to the full-latch state; and an actuator having an electric motor and driving the closer mechanism with power generated by the electric motor, wherein the closer mechanism comprises: an output lever one end of which is connected to the actuator; a driving lever designed such that one end thereof can be connected to the latch, and the other end of the output lever is connected to a middle part thereof; and a guide lever connected to the other end of the driving lever so as to guide the movement of the driving lever.

With the fifth feature, it is possible to construct the closer mechanism with a small number of parts, that is, the output lever, the driving lever and the guide lever, thereby easily disposing the closer mechanism in the door.

According to a sixth feature of the present invention, in addition to the fifth feature, the door lock device further comprises a mechanical cancel mechanism connected to the guide lever; and the mechanical cancel mechanism drives the guide lever so as to displace the driving lever to a side on which the connection between the guide lever and the latch is broken corresponding to an operation of a door opening operation handle during an operation of the closer mechanism. With the sixth feature, it is possible to stop the forced rotation of the latch form the half-latch state to the full-latch state by operating the door opening operation handle during the operation of the closer mechanism, thereby securing safety in emergency.

The above-mentioned object, other objects, characteristics, and advantages of the present invention will become apparent from a preferred embodiment, which will be described in detail below by reference to the attached drawings.

DESCRIPTION OF THE PREFERRED EMBODIMENT

Figure 1:
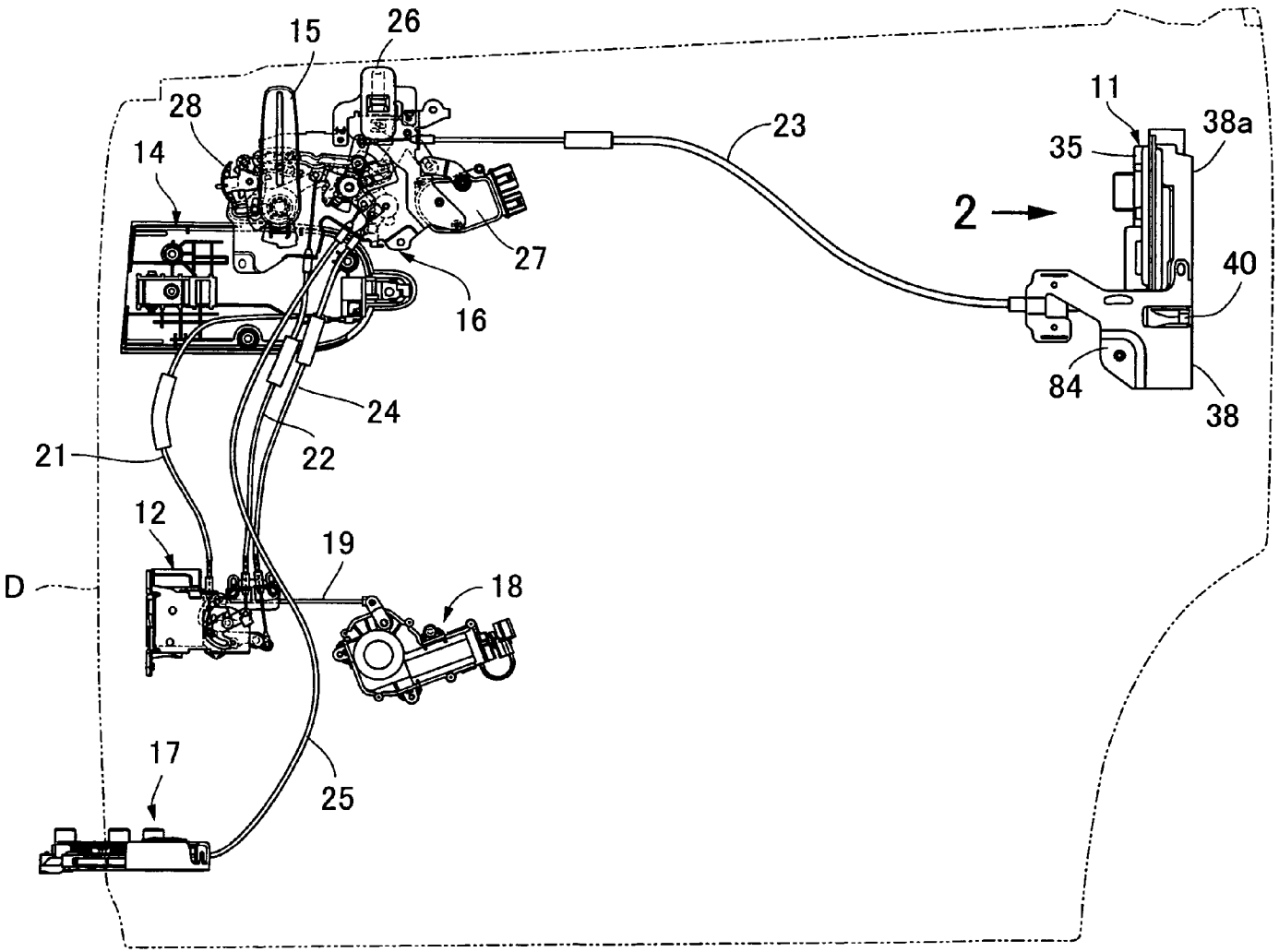
FIG. 1 is a front view of a door taken from a vehicle compartment side, showing one embodiment of the present invention.
Figure 2:
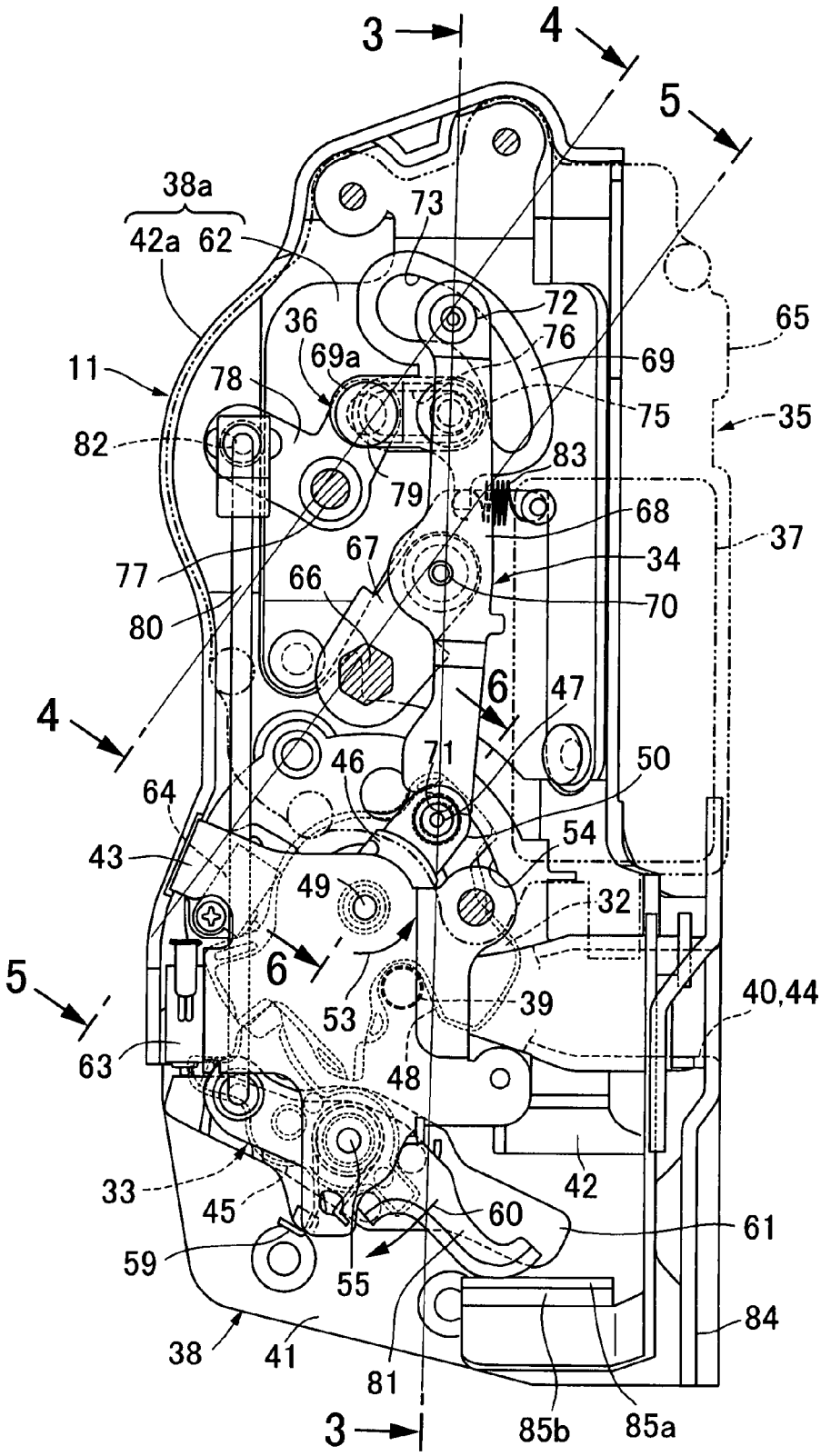
FIG. 2 is an enlarged view taken in the direction of the arrow 2 in FIG. 1 in a state in which an actuator is omitted.
Figure 3:
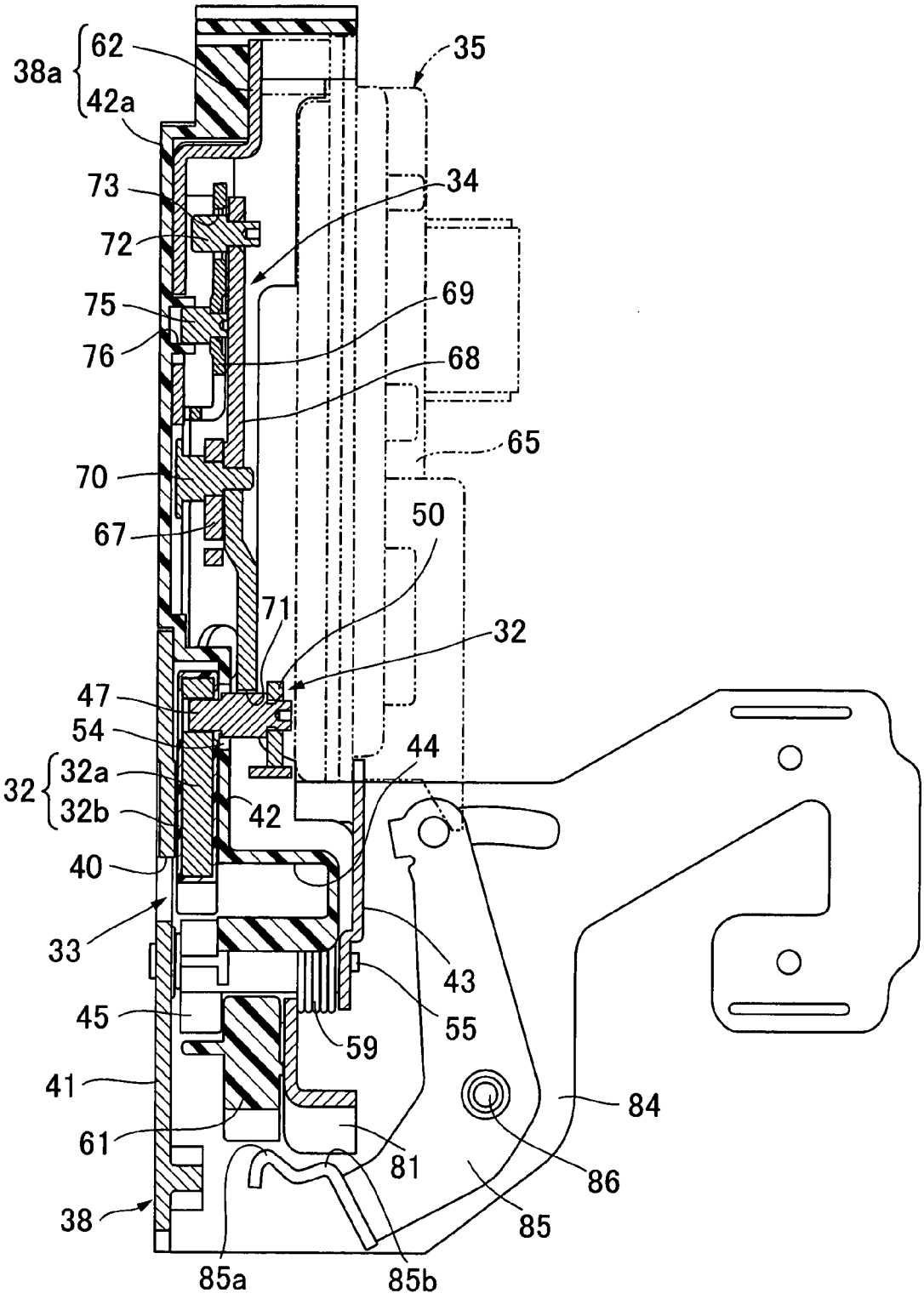
FIG. 3 is a sectional view taken along line 3-3 in FIG. 2.
Figure 4:
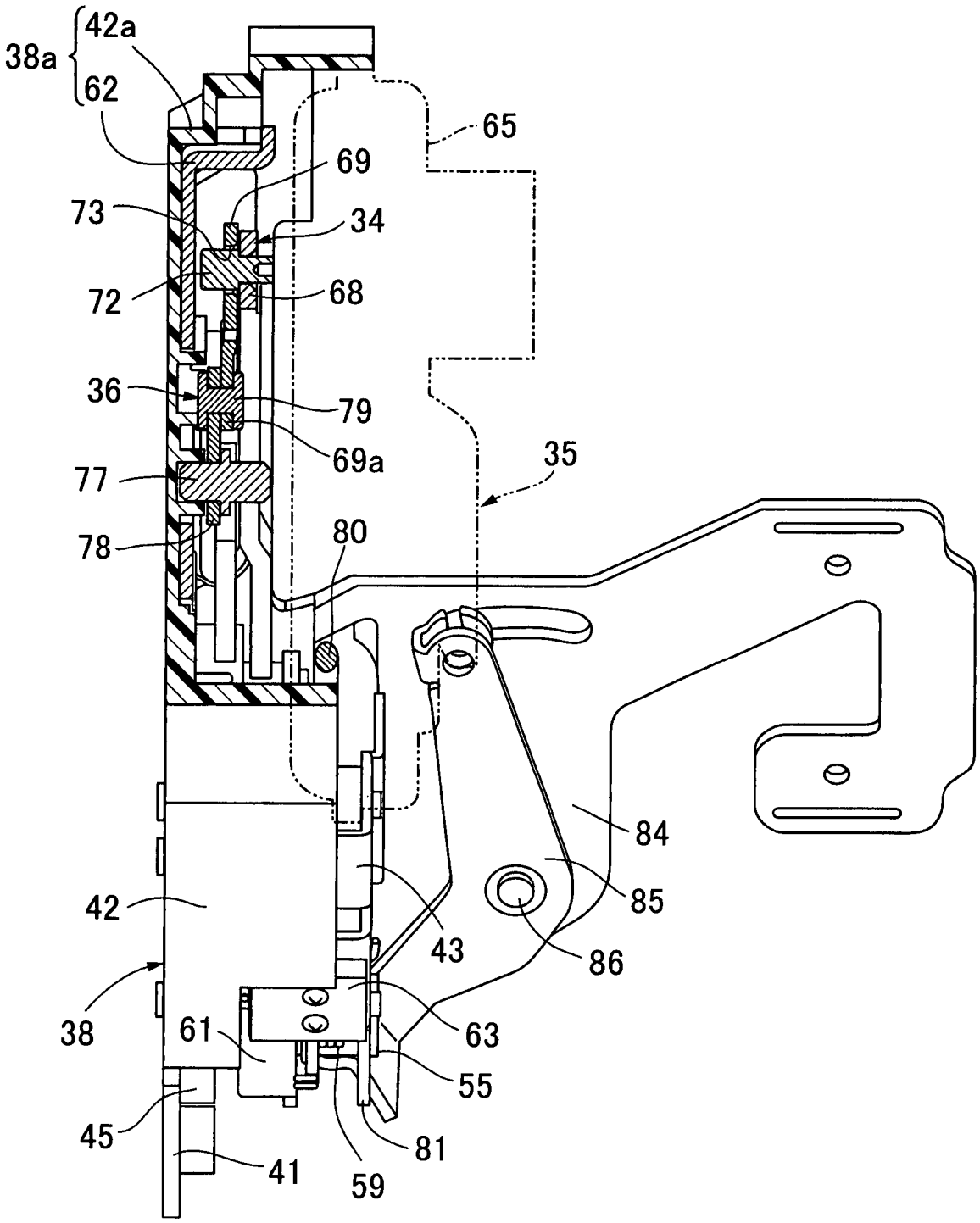
FIG. 4 is a sectional view taken along line 4-4 in FIG. 2.
Figure 5:
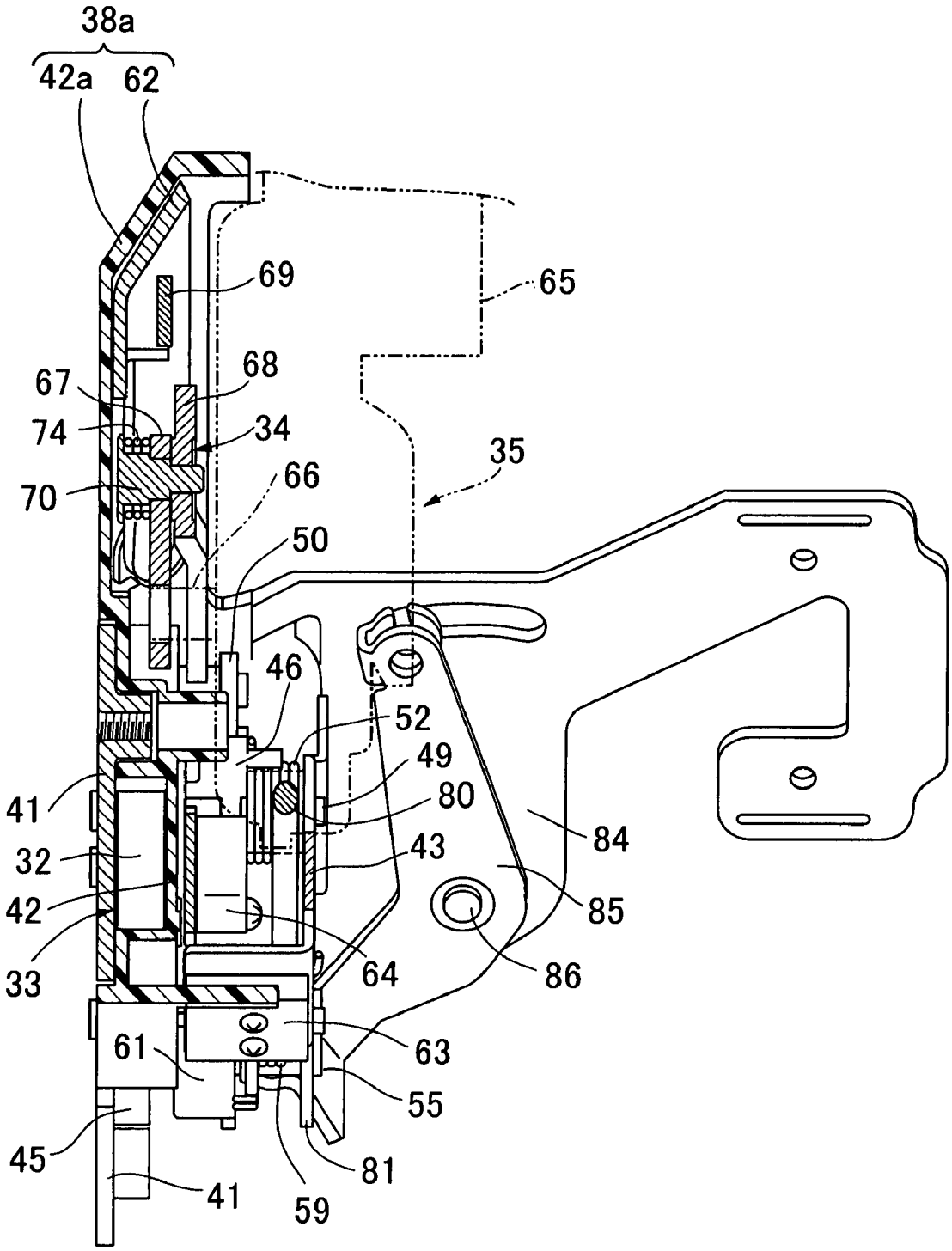
FIG. 5 is a sectional view taken along line 5-5 in FIG. 2.

In FIG. 1, a door D is mounted on the right side surface of an unshown vehicle body so as to be slidable in the front-rear direction between a closed position on a front side (left side in FIG. 1) and an opened position on a rear side (right side in FIG. 1). The door D is automatically opened and closed by an unshown motor-operated door opening/closing device.

In a rear part of the door D, there is provided a rear door lock device 11 according to the present invention, which engages the door D in a closed state with the vehicle body and maintains the closed state of the door D. In a front part of the door D, there is provided a front door lock device 12, which engages the door D in a closed state with the vehicle body and maintains the closed state of the door D. In a front upper part of the door D above the front door lock device 12, there is provided an outside handle mechanism 14 which enables a handle operation from outside of the door D. In an upper part of the door D at the rear of the outside handle mechanism 14, there is provided a remote control mechanism 16 which has an inside handle 15 serving as a door opening operation handle arranged inside the door D. In a front part of the door D below the front door lock device 12, there is provided a lower latch mechanism 17 which engages the door D in an opened state with the vehicle body and maintains the opened state of the door D. In the door D at the rear of the front door lock device 12, there is provided an unlocking actuator 18 which gives an unlocking power to the rear door lock device 11, the front door lock device 12 and the lower latch mechanism 17.

The operational force generated by the unlocking actuator 18 is transmitted via a rod 19 to the front door lock device 12. The operational force provided by the operation of the outside handle mechanism 14 is transmitted via a first transmission cable 21 to the front door lock device 12. The front door lock device 12 converts either of the operational force transmitted from the unlocking actuator 18 and the operational force transmitted from the outside handle mechanism 14, into a pulling force of a second transmission cable 22, while preventing the unlocking actuator 18 and the outside handle mechanism 14 from interfering with each other. The unlocking operational force transmitted through the second transmission cable 22 to the remote control mechanism 16, is transmitted to the rear door lock device 11, the front door lock device 12 and the lower latch mechanism 17 through third, fourth and fifth transmission cables 23, 24 and 25, respectively. The remote control mechanism 16 transmits the unlocking operational force provided by the operation of the inside handle 15 directly to the third, fourth and fifth transmission cables 23, 24 and 25.

When the switching operation for opening the door D is performed on a driver seat in the state in which the door D is closed, the unlocking actuator 18 is operated, whereby the power transmitted from the unlocking actuator 18 via the rod 19 to the front door lock device 12 is transmitted via the second transmission cable 22 to the remote control mechanism 16, and unlocking power is transmitted from the remote control mechanism 16 to the rear door lock device 11 and the front door lock device 12 via the third and fourth transmission cables 23 and 24, respectively. As a result, the rear and front door lock devices 11 and 12 are brought into the unlocked state. Therefore, the door D is automatically opened by the motor-driven door opening/closing device, and the fully-opened state of the door D is maintained by the locking operation of the lower latch mechanism 17 performed in the fully-opened state of the door D.

When the switching operation for closing the door D is performed on the driver seat in the state in which the door D is open, the unlocking actuator 18 is operated, whereby the power transmitted from the unlocking actuator 18 via the rod 19 to the front door lock device 12 is transmitted via the second transmission cable 22 to the remote control mechanism 16, and unlocking power is transmitted from the remote control mechanism 16 to the lower latch mechanism 17 via the fifth cable 25. As a result, the lower latch mechanism 17 is brought into the unlocked state, and therefore the door D is automatically closed by the motor-driven door opening/closing device. At this time, the rear door lock device 11 is operated so that the door D turns from the half-closed state to the fully-closed state, and correspondingly the front door lock device 12 performs locking operation, whereby the fully-closed state of the door D is maintained.

On the other hand, when the inside handle 15 is operated to open the door D in the closed state of the door D, the unlocking actuator 18 is operated according to such an opening operation. Therefore, the front door lock device 12, the remote control mechanism 16, the rear door lock device 11 and the unlocking actuator 18 are operated as in the case where the switching operation for opening the door D is performed on the driver seat, and the door D is automatically opened by the motor-driven door opening/closing device. Also, the lower latch mechanism 17 performs locking operation in the fully-opened state of the door D, whereby the fully-opened state of the door D is maintained.

Also, when the inside handle 15 is operated to close the door D in the opened state of the door D, the unlocking actuator 18 is operated corresponding to such a closing operation. Therefore, the front door lock device 12, the remote control mechanism 16 and the lower latch mechanism 17 are operated as in the case where the switching operation for closing the door D is performed on the driver seat, and the door D is automatically closed by the motor-driven door opening/closing device. The rear door lock device 11 is operated so that the door D turns from the half-opened state to the fully-closed state, and correspondingly the front door lock device 12 performs locking operation, whereby the fully-closed state of the door D is maintained.

Also in the case where the handle operation of the outside handle mechanism 14 is performed, as in the case of the above-described operation of the inside handle 15, the unlocking actuator 18, the front door lock device 12, the remote control mechanism 16, the rear door lock device 11 and the lower latch mechanism 17 are operated.

Provided on the remote control mechanism 16 are a lock knob 26 that operates between an upper unlock position and a lower lock position corresponding to manual operation, a lock switching actuator 27 that operates the lock knob 26 corresponding to the operation on the driver seat, and a child lock knob 28 that operates between an unlock position and a lock position corresponding to manual operation. Also, provided thereon are unshown switches for detecting the operation of the inside handle 15, and the operation input from the outside handle mechanism 14 via the first transmission cable 21, the front door lock device 12 and the second transmission cable 22.

The remote control mechanism 16 is constructed so that the operational force provided by the operation of the inside handle 15 and the force transmitted from the second transmission cable 22 are not transmitted to the third and fourth transmission cables 23 and 24, when the lock switching actuator 27 operates the knock knob 26 to the lock position corresponding to the operation on the driver seat side, or when the lock knob 26 is manually operated to the lock position side. Also, the remote control mechanism 16 is constructed so that the operational force provided by the operation of the inside handle 15 is not transmitted to the third and fourth transmission cables 23 and 24, and so that the unlocking actuator 18 is maintained in an inoperative state without detecting the opening operation of the inside handle 15, when the child lock knob 28 is operated to the lock position in the state in which the lock knob 26 is at the unlock position. Therefore, even if the opening operation of the inside handle 15 or the opening operation of the outside handle mechanism 14 is performed in the closed and locked state of the door D, the rear door lock device 11 and the front door lock device 12 do not operate to release the locked state.

Although the unlocking actuator 18 is essential to the lock device for the power sliding door D including the motor-driven door opening/closing device, the locked states of the rear door lock device 11, the front door lock device 12 and the lower latch mechanism 17 can be released without using the unlocking actuator 18. That is, the remote control mechanism 16 can transmit (1) the unlocking operational force provided by the operation of the outside handle mechanism 14 and transmitted via the first transmission cable 21, the front door lock device 12 and the second transmission cable 22, and (2) the unlocking operational force provided by the operation of the inside handle 15, directly to the third, fourth and fifth transmission cables 23, 24 and 25. In the case where the unlocking actuator 18 is in disorder or in the case of a non power-sliding door without the unlocking actuator 18, the locked states of the rear door lock device 11, the front door lock device 12 and the lower latch mechanism 17 can be released by the mechanical transmission of operational force provided by the operation of the outside handle mechanism 14 or the operation of the inside handle 15.

The rear door lock device 11 is constructed according to the present invention. The construction of the rear door lock device 11 is described with reference to FIGS. 2 to 9.

Referring to FIGS. 2 to 5, the rear door lock device 11 includes: a latch mechanism 33 having a latch 32 which can be rotated to pass a half-latch state where the door D is half closed and reach a full-latch state where the door D is fully closed while the door D is operated from an opened state to a closed state; a closer mechanism 34 capable of forcedly turning the latch 32 from the half-latch state to the full-latch state; an actuator 35 having an electric motor 37 and driving the closer mechanism 34 with power generated by the electric motor 37; and a mechanical cancel mechanism 36 capable of stopping the forced turning of the latch 32 caused by the closer mechanism 33.

A casing 38 of the latch mechanism 33 includes: a metallic base plate 41 having an opening 40 through which a striker 39 (see FIG. 2) provided on the vehicle body can be inserted; a box-shaped synthetic resin cover 42 that covers a part of the base plate 41 in a portion corresponding to the opening 40; and a metallic support plate 43 mounted on the base plate 41 so as to hold the cover 42 between the base plate 41 and the support plate 43. The cover 42 is provided with an insertion groove 44 corresponding to the opening 40.

Figure 6:
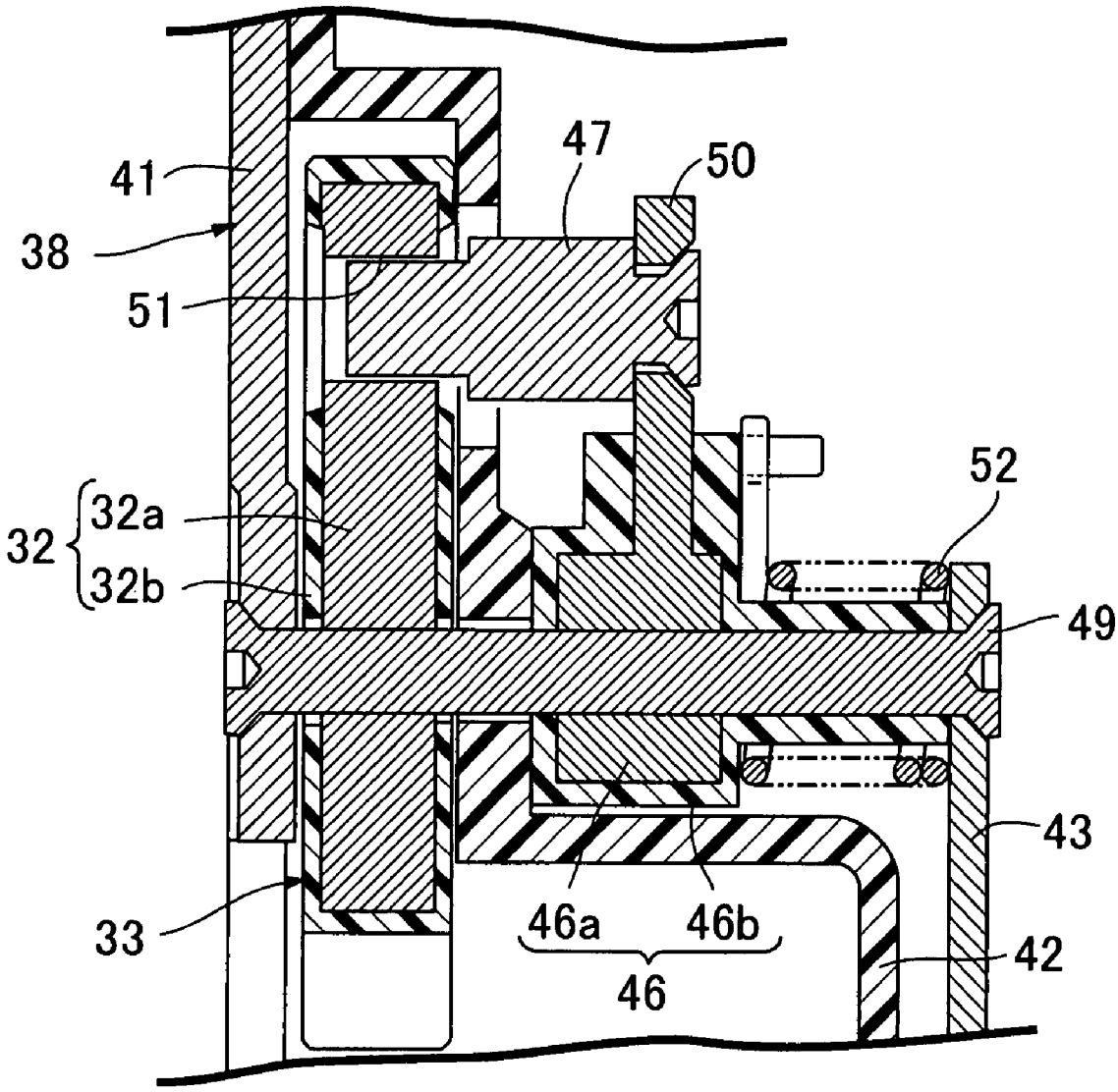
FIG. 6 is a sectional view taken along line 6-6 in FIG. 2.

Referring to FIGS. 6 and 7 together, the latch mechanism 33 includes: the latch 32 turnably supported on the casing 38 so as to engage with the striker 39 advancing into the insertion groove 44 through the opening 40 when the door D is operated from the opened state to the closed state; a ratchet 45 that is turnable around an axis parallel to the turning axis of the latch 32 so as to be capable of engaging with the latch 32; a latch lever 46 turnably supported on the casing 38 so as to be turnable around an axis coaxial with the latch 32; and an engagement pin 47 provided between the latch 32 and the latch lever 46.

The latch 32 includes a metallic latch main body 32*a*, and a synthetic resin cover element 32*b* covering an outer surface of the latch main body 32*a* except a part thereof. The latch 32 is arranged between the base plate 41 and the cover 42 in the casing 38. Provided around an outer periphery of the latch 32 is an engagement recess 48 which engages with the striker 39 advancing into the insertion groove 44. The ratchet 45 includes a metallic ratchet main body 45*a*, and a synthetic resin cover element 45*b* covering an outer surface of the ratchet main body 45*a* except a part thereof. The ratchet 45 is arranged between base plate 41 and the cover 42 in the casing 38. The latch lever 46 includes a metallic latch lever main body 46*a*, and a synthetic resin cover element 46*b* covering an outer surface of the latch lever main body 46*a* except a part thereof. The latch lever 46 is arranged between the cover 42 and the support plate 43 in the casing 38.

The latch 32 and the latch lever 46 are supported commonly and turnably by a first rivet shaft 49 that connects the base plate 41 and the support plate 43 to each other with the cover 42 being held therebetween. The latch lever main body 46*a* of the latch lever 46 integrally has an arm part 50 projecting from the cover element 46*b*. Fixed to the tip end of the arm part 50 is the base end of the engagement pin 47 having an axis parallel to the first rivet shaft 49. Fitted and connected to the tip end of the engagement pin 47 is a connection hole 51 provided in the latch 32. Therefore, the latch 32 and the latch lever 46 turn integrally around the axis of the first rivet shaft 49, and the latch 32 and the latch lever 46 are turnably urged by a spring force of a torsion coil spring 52 provided between the cover 42 and the latch lever 46 of the casing 38 in the direction indicated by an arrow 53 in FIG. 2 such that the open end of the engagement recess 48 is directed to the side on which the striker 39 advancing into the insertion groove 44 is engaged with the engagement recess 48. The engagement pin 47 is inserted through an insertion hole 54 provided in the cover 42. The insertion hole 54 is formed into an arcuate shape having a center at the axis of the first rivet shaft 49 so as to allow the latch 32 to turn.

On the other hand, the ratchet 45 is arranged between the base plate 41 and the cover 42 of the casing 38 on the side opposite to the latch 32 with respect to the insertion groove 44, and is turnably supported by a second rivet shaft 55 that connects the base plate 41 and the support plate 43 to each other with the cover 42 being held therebetween. Provided on the latch 45 is an engagement arm part 56 extending toward the latch 32. Provided around the outer periphery of the latch 32 are a half engagement step part 57 with which the engagement arm part 56 is brought into contact and engaged in the half-opened state of the door D, and a full engagement step part 58 with which the engagement arm part 56 is brought into contact and engaged in the fully-closed state of the door D. The ratchet 45 is elastically urged to the side on which the engagement arm part 56 is engaged with the latch 32 by the spring force of a spring 59 (see FIG. 2), namely, to the side indicated by an arrow 60 in FIG. 2.

A ratchet lever 61 is arranged at a position to sandwich the cover 42 in cooperation with the ratchet 45 so as to be turnably supported by the second rivet shaft 55 common to the ratchet 45. The ratchet lever 61 is turned together with the ratchet 45 so as to be engaged with the ratchet 45. The spring 59 is provided between the support plate 43 of the casing 38 and the ratchet lever 61.

A first switch 63 and a second switch 64 are mounted to the support plate 43. The first switch 63 changes the switching mode by means of the ratchet lever 61 that is turned together with the ratchet 45 when the ratchet 45 turns to a position at which the engagement arm part 56 is engaged with the half engagement step part 57 of the latch 32 turned to the half-latch state. The second switch 64 causes the latch lever 46, which is turned together with the latch 32 when the latch 32 turns to the full-latch state, to change the switching mode.

Referring again to FIGS. 2 to 5, the casing 38 is connected to an extending support part 38*a* that extends in the direction orthogonal to the turning axis of the latch 32, namely, the axis of the first rivet shaft 49. In this embodiment, the extending support part 38*a* extends upward from the casing 38. The extending support part 38*a* includes an upwardly extending cover part 42*a* that integrally connects to the cover 42 of the casing 38, and a metallic reinforcing plate 62 that is fastened to the inner surface of the extending cover part 42*a*.

The actuator 35 is mounted on the casing 38 so as to cover the extending support part 38*a* of the casing 38. The closer mechanism 34 is formed so as to operate on a plane orthogonal to the turning axis of the latch 32, and is arranged between the actuator 35 and the extending support part 38*a* so as to be aligned with the latch mechanism 33.

The actuator 35 includes: an actuator housing 65; the electric motor 37 having a turning axis extending along a plane orthogonal to the turning axis of the latch 32; and a speed reducing mechanism (not shown) for decelerating the turning power of the electric motor 37, the electric motor 37 and the speed reducing mechanism being housed inn the actuator housing 65. An output shaft 66 of the actuator 35 projects from the actuator housing 65 toward the extending support part 38*a*.

The closer mechanism 34 includes: an output lever 67 one end of which is fixedly connected to the actuator 35; a driving lever 68 one end thereof can be connected to the engagement pin 47 turning around the axis of the first rivet shaft 49 together with the latch 32, and the other end of the output lever 67 is connected to a middle part thereof; and a guide lever 69 connected to the other end of the driving lever 68 so as to guide the movement of the driving lever 68.

The driving lever 68 extends in upward and downward directions. The other end of the output lever 67 is connected to the middle part of the driving lever 68 via a connection shaft 70. The output lever 67 is turned in the clockwise direction in FIG. 2 corresponding to the operation of the actuator 35, and the driving lever 68 is pressed downward corresponding to the turning of the output lever 67. At one end (lower end) of the driving lever 68, there is provided a connecting part 71 capable of contact and engaging from above with the outer periphery of the engagement pin 47 when the latch 32 engaging with the striker 39 in the inoperative time of the actuator 35 is turned to the half-latch state. The connecting part 71 is formed so as to be capable of shutting off the closer mechanism 34 from the latch 32 by breaking the connection with the engagement pin 47 when the driving lever 68 is turned in the counterclockwise direction in FIG. 2 around the axis of the connection shaft 70. A torsion coil spring 74 (see FIG. 5) is provided between the output lever 67 and the driving lever 68 so as to surround the connection shaft 70. The driving lever 68 is urged by the elastic force exerted by the torsion coil spring 74 to the side on which the connecting part 71 thereof is brought into contact and engaged with the engagement pin 47, namely, in the clockwise direction in FIG. 2.

A guide pin 72 provided at the other end of the driving lever 68 is inserted through a guide hole 73 formed in the guide lever 69. The guide hole 73 is formed to guide the movement of the driving lever 68 so that the driving lever 68 follows the movement of the engagement pin 47 when the driving lever 68 presses the engagement pin 47 by the connecting part 71 corresponding to the turning of the output lever 67 to turn the engagement pin 47 and the latch 32 to the full-latch position.

A guide shaft 75 is insertedly provided in the guide lever 69. The guide shaft 75 is slidably fitted in a guide groove 76 (see FIGS. 2 and 3) provided in the extending cover part 42*a* so as to penetrate the reinforcing plate 62 of the extending support part 38*a*, so that the guide lever 69 is slidable along the guide groove 76. The guide groove 76 is formed so as to extend long in the direction substantially orthogonal to the lengthwise direction of the driving lever 68. The guide lever 69 is integrally provided with a connection arm part 69*a* extending along the lengthwise direction of the guide groove 76. The mechanical cancel mechanism 36 is connected to the connection arm part 69*a*.

The mechanical cancel mechanism 36 includes: a door handle connecting lever 78 that is turnably supported on the extending cover part 42*a* in the extending support part 38*a* via a support shaft 77 (see FIG. 4), and is connected to the connection arm part 69*a* of the guide lever 69 via a connection shaft 79; a connecting rod 80 one end of which is connected to the door handle connecting lever 78 and which extends vertically; and a cancel lever 81 that is turnably supported by the second rivet shaft 55 common to the ratchet 45 and the ratchet lever 61, and is connected to the other end of the connecting rod 80. At least a part of the mechanical cancel mechanism 36, that is, the door handle connecting lever 78 and a part of the connecting rod 80 in this embodiment, are arranged between the actuator 35 and the extending support part 38*a*.

One end of the door handle connecting lever 78, which is formed substantially into a V shape and the middle part of which is turnably supported by the support shaft 77, is connected to the connection arm part 69*a* via the connection shaft 79. A connection hole 82 for connection of one end of the connecting rod 80 is provided at the other end of the door handle connecting lever 78. The cancel lever 81 is turnably supported by the second rivet shaft 55 between the ratchet lever 61 and the support plate 43 of the casing 38. The other end of the connecting rod 80 is connected to one end of the cancel lever 81.

A coil spring 83 (see FIG. 2) is provided under compression between the reinforcing plate 62 in the extending support part 38*a* and the guide lever 69. The spring force of the coil spring 83 provides a turning urging force acting on a region from the guide lever 69 to the door handle connecting lever 78 of the mechanical cancel mechanism 36 and in the direction to turn the door handle connecting lever 78 to the side on which the connecting rod 80 is pulled upward (the clockwise direction in FIG. 2). The turning of the cancel lever 81 corresponding to the upward displacement of the connecting rod 80 is restricted by the cover 42 of the casing 38. Therefore, unless a force to pull down the connecting rod 80 acts on the cancel lever 81, the guide lever 69 and the door handle connecting lever 78 stand still at the positions shown in FIG. 2.

Figure 7A:
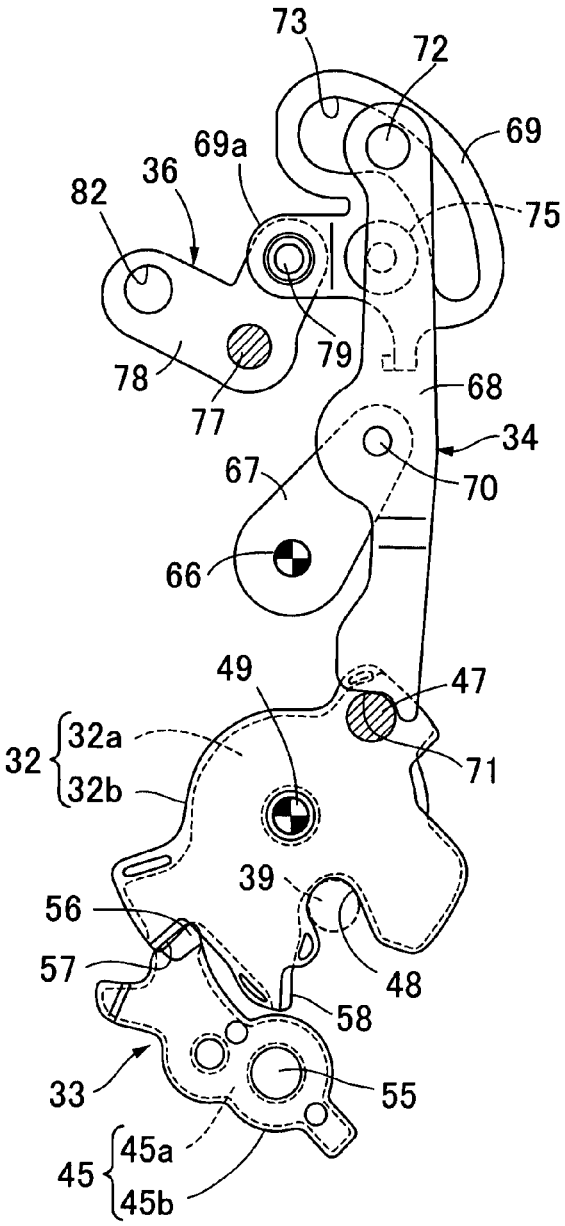
FIGS. 7A and 7B are views for comparison between a half-latch state and a full-latch state, showing operations of a latch mechanism, a closer mechanism and a mechanical cancel mechanism.
Figure 7B:
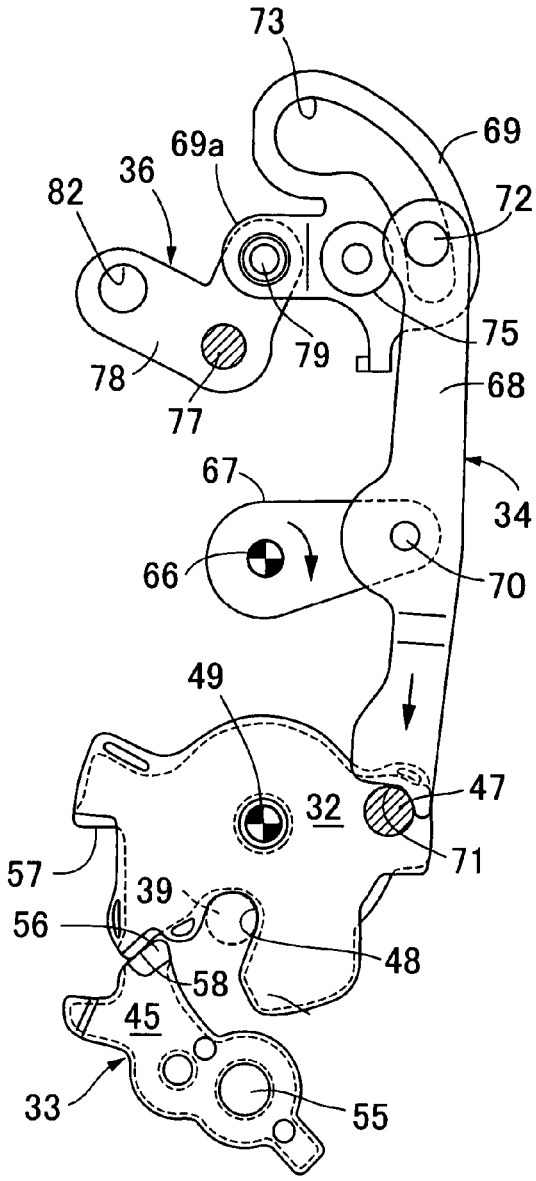

As shown in FIG. 7A, when the latch 32 is turned to the half-latch state by the ingression of the striker 39, the engagement pin 47 comes into contact and engages with the connecting part 71 at the lower end of the driving lever 68 of the closer mechanism 34, and the first switch 63 detects the turning of the latch 32 to the half-latch state so that the actuator 35 is operated. Therefore, the driving lever 68 is moved downward while pushing the engagement pin 47, and as shown in FIG. 7B, the latch 32 is forcedly turned to the full-latch state.

A bracket 84 extending at right angles to the base plate 41 is formed integrally on the base plate 41 of the casing 38. The middle part of a release lever 85 whose one end is connected to the third transmission cable 23 is turnably supported via a support shaft 86 on the bracket 84. A first contact part 85*a* and a second contact part 85*b* are provided at the other end of the release lever 85. The first contact part 85*a* comes into contact with the ratchet lever 61 to turn the ratchet lever 61 in the direction reverse to the turning urging direction of the spring 59. The second contact part 85*b* comes into contact with the cancel lever 81 to turn the cancel lever 81 in the direction reverse to the turning urging direction of the coil spring 83, namely, in the direction to pull down the connecting rod 80.

That is, when the third transmission cable 23 is pulled corresponding to the operation of the inside handle 15, the release lever 85 turns the ratchet lever 61 in the direction reverse to the turning urging direction of the spring 59, and also turns the cancel lever 81 in the direction to pull down the connecting rod 80.

Figure 8:
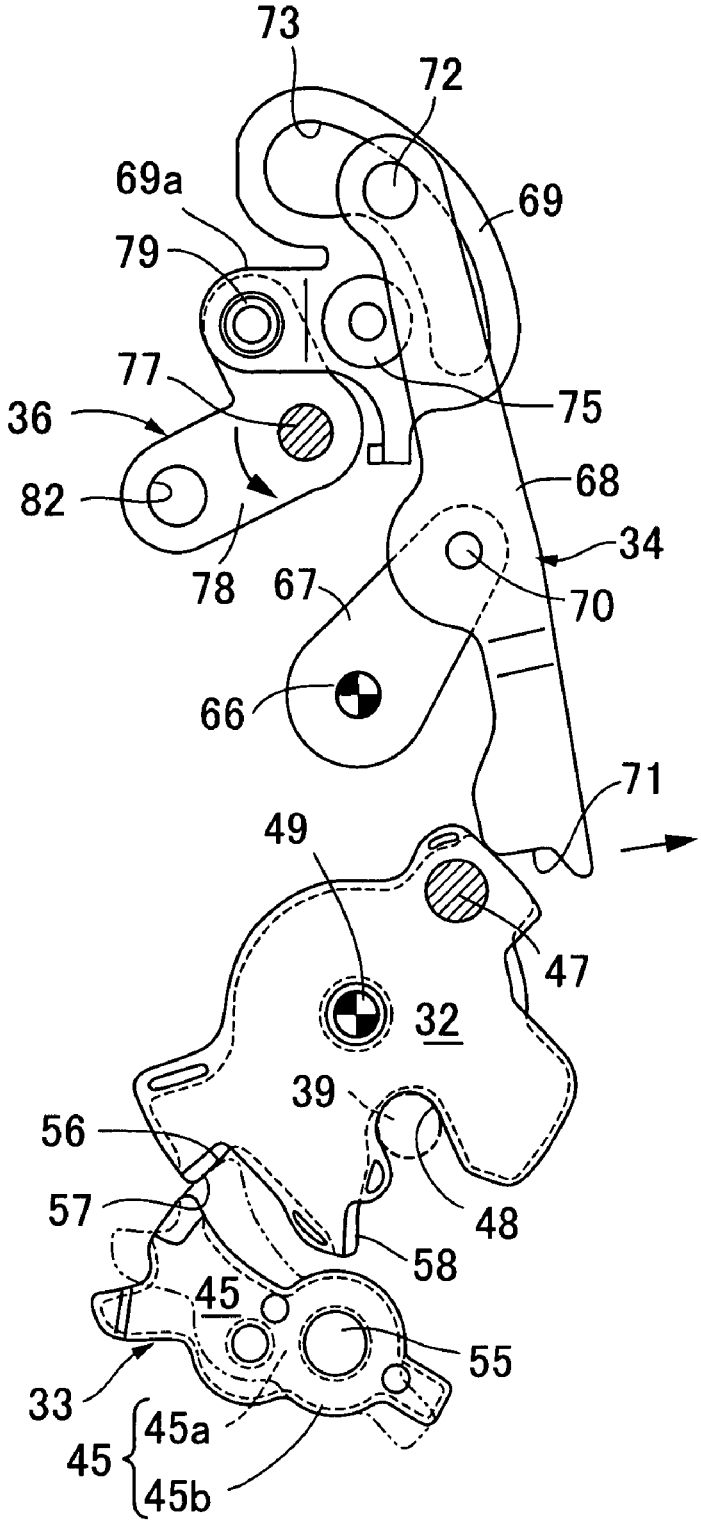
FIG. 8 is a view corresponding to FIG. 7 in a state in which the mechanical cancel mechanism operates in the half-latch state.

As shown in FIG. 7A, when the latch 32 is in the half-latch state if the inside handle 15 is operated, the connecting rod 80 is pulled down as shown in FIG. 8, and correspondingly the door handle connecting lever 78 turns in the counterclockwise direction in FIG. 8. Therefore, the guide lever 69 connected to the door handle connecting lever 78 slides to the left side in FIG. 8 against the spring force of the spring 83, whereby the driving lever 68 is turned in the counterclockwise direction around the axis of the connection shaft 70, and the connecting part 71 having been in contact and engaged from above with the outer periphery of the engagement pin 47 is disconnected from the engagement pin 47 and displaced to the side on which the connection between the closer mechanism 34 and the latch 32 is cut. At this time, the ratchet lever 61 is turned by the first contact part 85*a* provided on the release lever 85, and correspondingly the ratchet 45 turns to a position at which the ratchet 45 is disengaged from the latch 32.

Figure 9:
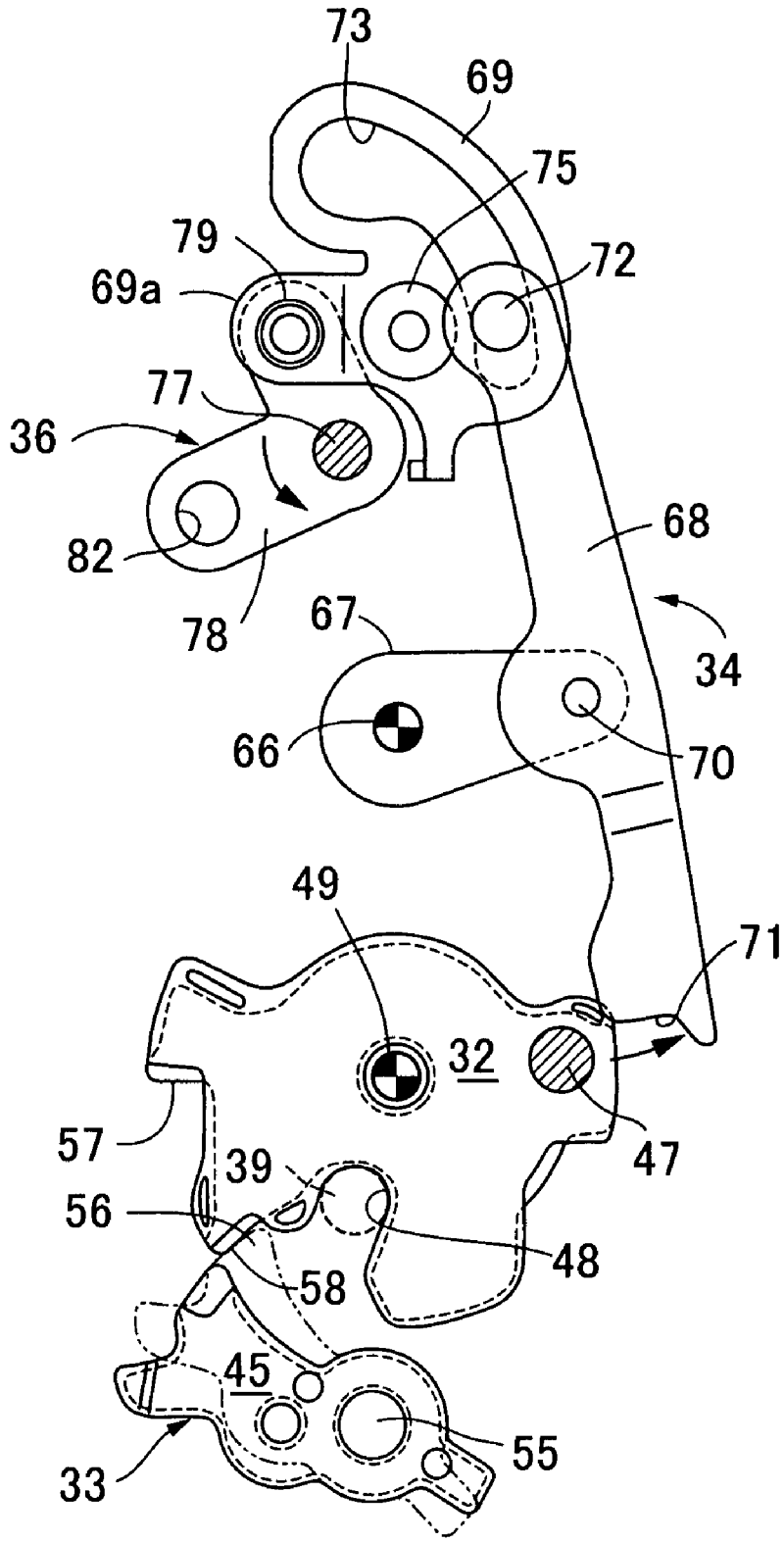
FIG. 9 is a view corresponding to FIG. 7 in a state in which the mechanical cancel mechanism operates in the full-latch state.

As shown in FIG. 7B, when the latch 32 is in the full-latch state if the inside handle 15 is operated, the connecting rod 80 is pulled down as shown in FIG. 9, and correspondingly the door handle connecting lever 78 turns in the counterclockwise direction in FIG. 9. Therefore, the guide lever 69 connected to the door handle connecting lever 78 slides to the left side in FIG. 9 against the spring force of the spring 83, whereby the driving lever 68 is turned in the counterclockwise direction around the axis of the connection shaft 70, and the connecting part 71 having been in contact and engaged from above with the outer periphery of the engagement pin 47 is disconnected from the engagement pin 47 and displaced to the side on which the connection between the closer mechanism 34 and the latch 32 is cut. Also in this case, the ratchet 45 turns to a position at which the ratchet 45 is disengaged from the latch 32.

That is, if the inside handle 15 is operated on the process that the latch 32 is forcedly turned from the half-latch state to the full-latch state by the operation of the closer mechanism 34, the mechanical cancel mechanism 36 slides the guide lever 69 so that the connection to the latch 32 is broken and the driving lever 68 is displaced to the side on which the connection between the closer mechanism 34 and the latch 32 is cut.

Even if an outside handle (not shown) provided in the outside handle mechanism 14 is operated, in place of the inside handle 15, on the process that the latch 32 is forcedly turned from the half-latch state to the full-latch state by the operation of the closer mechanism 34, as in the case where the inside handle 15 is operated, the mechanical cancel mechanism 36 operates to break the connection to the latch 32 and the driving lever 68 is displaced to the side on which the connection between the closer mechanism 34 and the latch 32 is cut.

Next, the operation of this embodiment is described. The casing 38 of the latch mechanism 33 is mounted to the door. The latch mechanism 33 has the latch 32 which can be rotated to pass the half-latch state where the door D is half closed and reach a full-latch state where the door D is fully closed while the door D is operated from the opened state to the closed state. The extending support part 38*a* extending in the direction orthogonal to the turning axis of the latch 32 is connectingly provided in the casing 38. The actuator 35 is mounted on the casing 38 so as to cover the extending support part 38*a* of the casing 38. The closer mechanism 34 is constructed to be operated on the plane orthogonal to the turning axis of the latch 32, and is disposed between the actuator 35 and the extending support part 38*a* so as to be aligned with the latch mechanism 33. In this embodiment, the closer mechanism 34 is arranged above the latch mechanism 33.

Because the actuator 35 and the closer mechanism 34 are arranged to be aligned with the latch mechanism 33 as described above, the entire rear door lock device 11 can be formed to be thin. Therefore, the door lock device according to the present invention is advantageous in disposing the rear door lock device 11 in a limited space in the door D. Further, the construction in which the closer mechanism 34 is arranged above the latch mechanism 33 is particularly effective in the case where the door D has no space margin below the rear door lock device 11, for example, in the case where the lower part on the rear side of the door D has a shape that is concave forward corresponding to a wheel house as shown in FIG. 1.

Also, the closer mechanism 34 has a simple construction with a small number of parts, that is, the output lever 67 one end of which is connected to the actuator 35, the driving lever 68 constructed so that one end thereof can be connected to the latch 32 and the other end of the output lever 67 is connected to the middle part thereof, and the guide lever 69 connected to the other end of the driving lever 68 so as to guide the movement of the driving lever 68. Therefore, the closer mechanism 34 can be easily disposed in the door D.

Further, the rear door lock device 11 comprises the mechanical cancel mechanism 36 that drives the guide lever 69 so that the driving lever 68 is displaced to the side on which the connection to the latch 32 is broken corresponding to the operation of the inside handle 15 during the operation of the closer mechanism 34. The connection between the closer mechanism 34 and the latch 32 is cut by operating the inside handle 15 during the operation of the closer mechanism 34, thereby stopping the forced rotation of the latch form the half-latch state to the full-latch state to secure safety in emergency.

Furthermore, because at least a part of the mechanical cancel mechanism 36 is arranged between the actuator 35 and the extending support part 38*a*, the entire rear door lock device 11 including the mechanical cancel mechanism 36 can be compactly formed.

The embodiment of the present invention has been described above, however, the invention is not limited to the above-described embodiment, and various modifications in design may be made without departing from the subject matter of the invention described in the claims.

For example, the description of the embodiment has been made to the case where the present invention is applied to the door D that is slidingly operated, but the present invention can be carried out relating to a door that is turnably supported on a vehicle body by a hinge mechanism.

What is claimed is:

1. A door lock device for a vehicle, comprising:

a latch mechanism having a latch which can be rotated to pass a half-latch state where the door is half closed and reach a full-latch state where the door is fully closed while the door is operated from an opened state to a closed state;

a closer mechanism capable of forcedly turning the latch from the half-latch state to the full-latch state; and an actuator having an electric motor and driving the closer mechanism with power generated by the electric motor, wherein the closer mechanism comprises: an output lever one end of which is connected to the actuator; a driving lever designed such that one end thereof can be connected to the latch, and the other end of the output lever is connected to the middle part of the driving lever; and a guide lever connected to the other end of the driving lever so as to guide the movement of the driving lever; and a mechanical cancel mechanism connected to the guide lever; and the mechanical cancel mechanism drives the guide lever so as to displace the driving lever to a side on which the connection between the guide lever and the latch is broken corresponding to an operation of a door opening operation handle during an operation of the closer mechanism.

* * * * *